US006811437B2

(12) United States Patent
Nimura

(10) Patent No.: US 6,811,437 B2
(45) Date of Patent: Nov. 2, 2004

(54) CONNECTOR AND METHOD OF MOUNTING IT

(75) Inventor: Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/620,234

(22) Filed: Jul. 15, 2003

(65) Prior Publication Data

US 2004/0067686 A1 Apr. 8, 2004

(30) Foreign Application Priority Data

Jul. 25, 2002 (JP) ..... 2002-216164

(51) Int. Cl.[7] ..... H01R 13/40
(52) U.S. Cl. ..... 439/595; 439/352; 439/752
(58) Field of Search ..... 439/352, 594, 439/595, 597, 598, 599, 752

(56) References Cited

U.S. PATENT DOCUMENTS 5,292,261 A * 3/1994 Hirano et al. ..... 439/752
5,490,802 A * 2/1996 Plyler et al. ..... 439/752
5,575,692 A * 11/1996 Cecil et al. ..... 439/752

FOREIGN PATENT DOCUMENTS

JP 8-298166 11/1996

* cited by examiner

*Primary Examiner*—P. Austin Bradley
*Assistant Examiner*—James R. Harvey
(74) *Attorney, Agent, or Firm*—Gerald E. Hespos; Anthony J. Casella

(57) ABSTRACT

A retainer (40) has left and right pivotally displaceable locking pieces (47) and is held at a partial locking position on a housing (30) by the engagement of engageable portions (50) at the leading ends of the locking pieces (47) with partial locking projections (31) on the housing (30). Thus, even if the retainer (40) is pushed inadvertently, such a push is restricted by the contact of the contact surfaces with the restricting surfaces (37). Pressable portions (55) of the locking pieces (47) can be pressed while holding the opposite side surfaces of the retainer (40) by fingers. This causes the locking pieces (47) to displace pivotally outward and the engageable portions (50) disengage from the restricting surfaces (37). Thus, the retainer (40) can be pushed to a full locking position.

16 Claims, 13 Drawing Sheets

CONNECTOR AND METHOD OF MOUNTING IT

BACKGROUND OF THE INVENTION

1. Field of the Invention

The invention relates to a connector with a retainer.

2. Description of the Related Art

Japanese Unexamined Patent Publication No. 8-298166 discloses a connector with a housing formed with cavities that receive terminal fittings. Resiliently deformable locks are formed in the cavities and lock terminal fittings that have been inserted properly into the cavities. A retainer is mounted on the front of the housing for movement between a partial locking position and a full locking position. The terminal fittings can be pushed into the cavities when the retainer is at the partial locking position. As a result, the terminal fittings resiliently deform the locks toward a deformation space. Each lock is restored resiliently when the terminal fitting is pushed to a proper position. Thus, the locks engage the terminal fitting to prevent the terminal fitting from coming out. The retainer is pushed to the full locking position when the terminal fittings have been inserted properly. The retainer enters the deformation spaces to prevent deformation of the locks. As a result, the terminal fittings indirectly are locked doubly.

The retainer is held at the partial locking position in the housing and transported to a site for inserting the terminal fittings. The retainer is pushed to the full locking position after the terminal fittings are inserted. The retainer projects from the front surface of the housing at the partial locking position. Thus, there is a possibility that the retainer will be pushed inadvertently to the full locking position, for example, due to contact with other connectors during transportation. The retainer then needs to be returned to the partial locking position before the terminal fittings are inserted, and hence the assembling operation is more cumbersome.

The invention was developed in view of the above, and an object is to prevent a retainer from being moved inadvertently to a full locking position.

SUMMARY OF THE INVENTION

The invention relates to a connector that comprises a housing formed with at least one cavity for receiving at least one terminal fitting. A retainer is mounted on a retainer mounting surface that preferably is at the front surface of the housing. The retainer is movable between a first locking position where the retainer permits insertion and withdrawal of the terminal fittings into and from the cavities and a second locking position where the retainer locks the terminal fittings in the cavities. The retainer comprises at least one resiliently deformable locking piece that engages a restricting portion on the housing for preventing the retainer from being pushed from the first locking position to the second locking position. The locking piece can be pressed and deformed resiliently for disengagement from the restricting portion.

Engagement of the locking piece with the restricting portion prevents the retainer from being pushed inadvertently to the second locking position. On the other hand, the locking piece can be pressed and disengaged from the restricting portion so that the retainer can be pushed toward the second locking position.

The retainer cannot be pushed to the second locking position until the locking piece is actively pressed. Accordingly, operability is improved.

Each cavity preferably has a resiliently deformable lock for partially locking the terminal fitting in the cavity.

The retainer preferably is provided for locking the terminal fittings redundantly. More particularly, the retainer, in the first locking position, is retracted from deformation spaces for the locks. Thus, the terminal fittings can be inserted into and withdrawn from the cavities. However, the retainer, in the second locking position, is in the deformation spaces and prevents deformation of the locks.

The retainer at the partial locking position could be struck by external matter or otherwise be pushed. However, the locking piece engages the restricting portion and prevents the retainer from being pushed to the full locking position. On the other hand, the locking piece can be pressed and deformed out of engagement with the restricting portion so that he retainer can be pushed to the full locking position. Thus, the retainer cannot be pushed inadvertently to the full locking position, but can be pushed to the full locking position when the locking piece is actively pressed.

The locking piece preferably is at a position to be pressed as substantially opposite side surfaces of the retainer are held by fingers. Thus, the locking piece is pressed and disengaged from the restricting portion as the retainer is held by fingers, and the retainer can reach the full locking position by being pushed while continuing to be held by fingers. Accordingly, the operations of disengaging the locking piece and pushing the retainer can be performed by one continuous movement.

The restricting portion preferably is a projection, and the retainer is prevented from being pushed to the second locking position by contact of an engageable portion at a projecting end of the locking piece with one surface of the restricting portion. Thus, the retainer is held at the full locking position by the contact of the engageable portion with another surface of the restricting portion.

Contact of the engageable portion of the locking piece with the front surface of the restricting portion prevents the retainer from being pushed to the full locking position. The retainer is pushed to the full locking position and the locking piece makes a returning movement after the locking piece is disengaged from the restricting portion. Thus, the engagement of the engageable portion with the back surface of the restricting portion prevents the retainer from coming off when the retainer is held at the full locking position.

A guiding surface may be defined at a leading inner end surface of the engageable portion and slopes moderately out toward the leading end.

Locking pieces may be at opposite sides of the retainer. Thus, the retainer is prevented, in a well-balanced manner from being pushed inadvertently.

The locking piece preferably is supported pivotably on the retainer by at least one support and is displaceable like a seesaw about the supports.

The locking piece preferably can be pressed at a right angle to a mounting direction of the retainer.

The invention also relates to a method of assembling a connector. The method comprises providing a housing formed with cavities into which terminal fittings are insertable. The method continues by mounting a retainer on a retainer mounting surface of the housing for movement between first and second locking positions. The terminal fittings can be inserted into the cavities and withdrawn from the cavities when the retainer is in the first locking position. However, movement of the retainer to the second locking position locks the terminal fittings. At least one resiliently deformable locking piece of the retainer is provided for engaging a restricting portion on the housing and preventing the retainer from being pushed from the first locking position to the second locking position. The locking piece can be pressed and deformed resiliently out of engagement with the restricting portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention has a plurality of female terminal fittings 10, each of which has opposite front and rear ends. A rectangular tubular connecting portion 11 is formed at the front end and is configured to receive a tab (not shown) of a mating male terminal. Barrels 13 are provided at the rear end of the female terminal fittings 10 and can be crimped, bent or folded into connection with an end of a wire 15.

Figure 2:
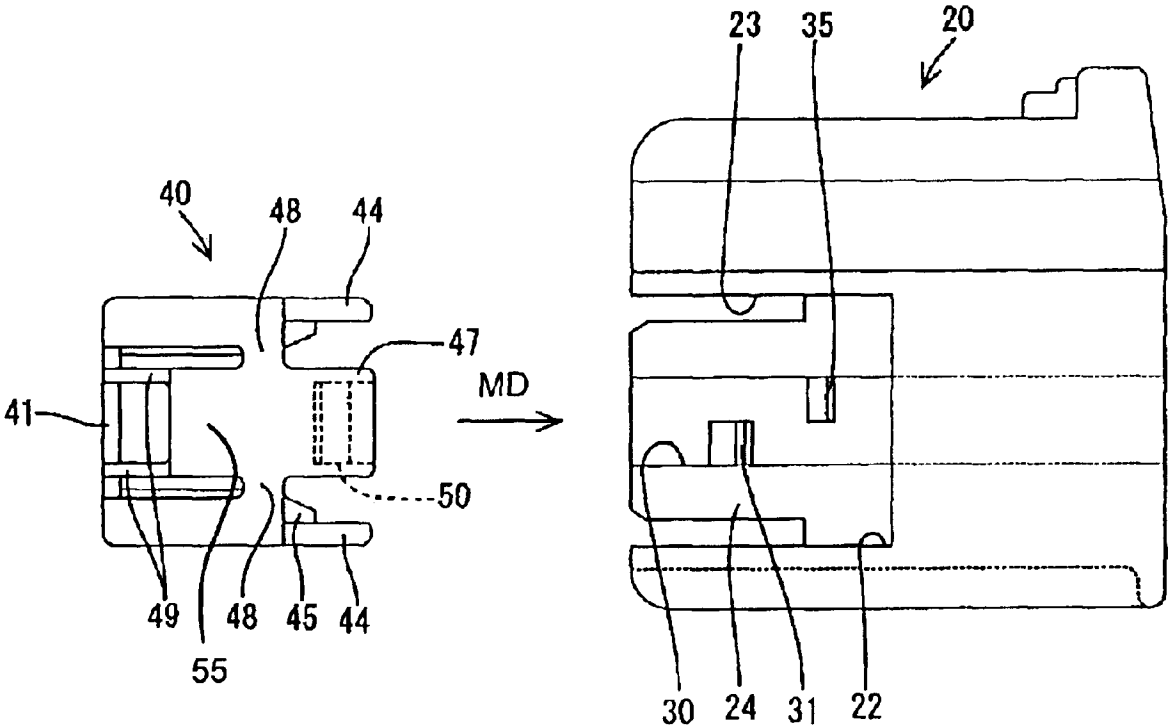
FIG. 2 is a side view showing a state before a retainer is mounted.
Figure 3:
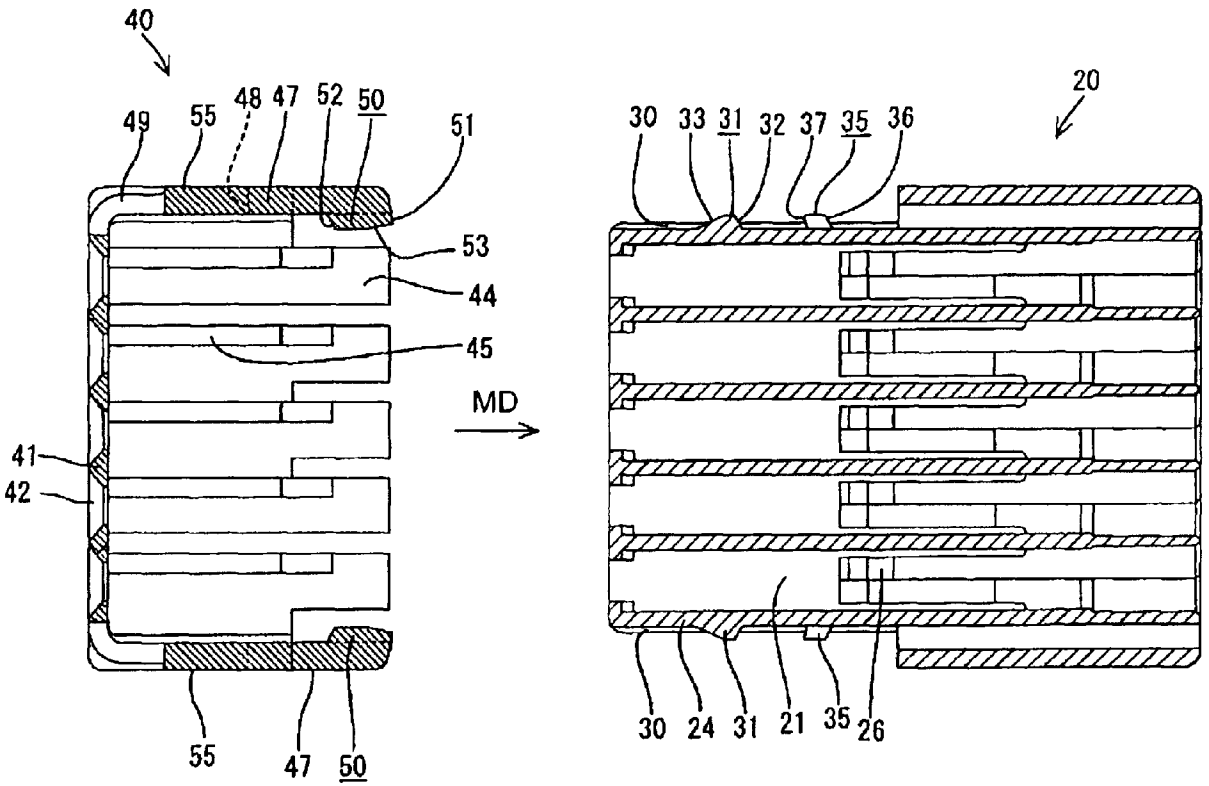
FIG. 3 is a plan view in section showing the state of FIG. 2.
Figure 4:
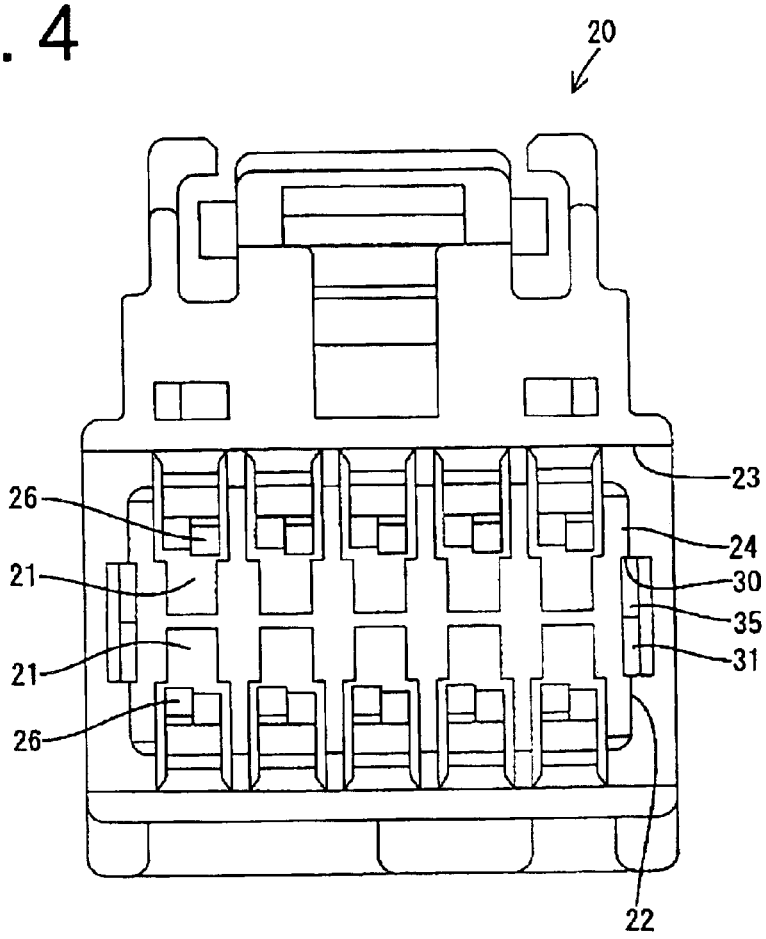
FIG. 4 is a front view of a female housing.

The connector also includes a female housing 20. The female housing 20 is made e.g. of a synthetic resin and is substantially in the form of a block, as shown in FIGS. 2 to 4. Cavities 21 are arrayed at upper and lower stages in the female housing 20 and are configured to receive the female terminal fittings 10 inserted along an insertion direction ID. Grooves 22, 23 are formed at the front of the left, right, upper and lower surfaces of the female housing 20 to define a tower 24 inside the grooves 22, 23.

A lock 26 is formed at the ceiling or bottom surface of each cavity 21, and is resiliently deformable into a deformation space 27 adjacent the respective lock 26. Each deformation space 27 is open to the front.

Figure 5:
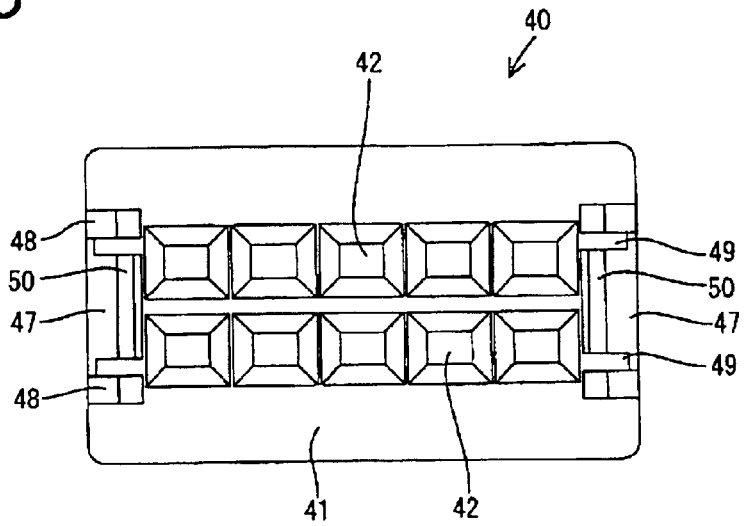
FIG. 5 is a front view of the retainer.
Figure 6:
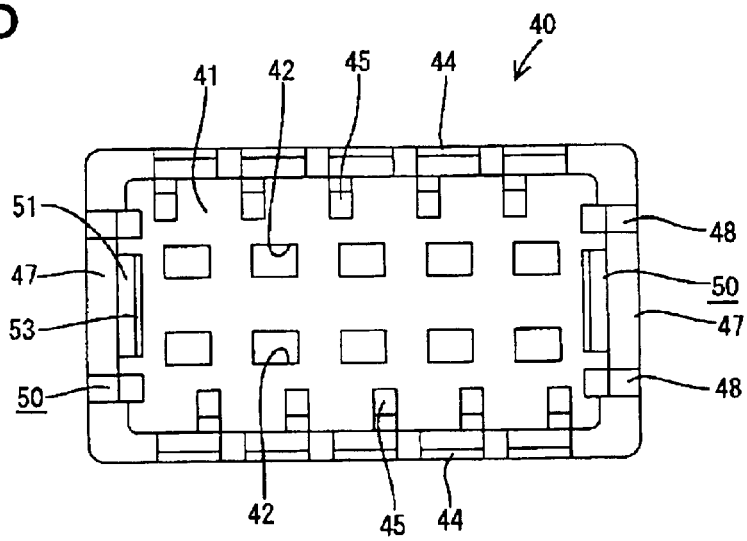
FIG. 6 is a rear view of the retainer.

The connector further includes a retainer 40 that is made e.g. of a synthetic resin. The retainer 40 is substantially in the form of a cap that fits around the tower 24 from the front. A front plate 41 of the retainer 40 also functions as the front wall of each cavity 21, and has terminal insertion openings 42 through which the tabs of the mating male terminals are insertable. The terminal insertion openings 42 are formed at positions substantially corresponding to the respective cavities 21, as shown in FIGS. 5 and 6.

Intruding pieces 44 project from the leading ends of the upper and lower plates of the retainer 40 and project substantially along the mounting direction MD into the deformation spaces 27 for the locks 26. Elongated shake-preventing projections 45 are formed on the inner surfaces of the upper and lower plates of the retainer 40 for receiving the surfaces of the connecting portions 11 of the female terminals 10 that engage the locks 26.

Figure 8:
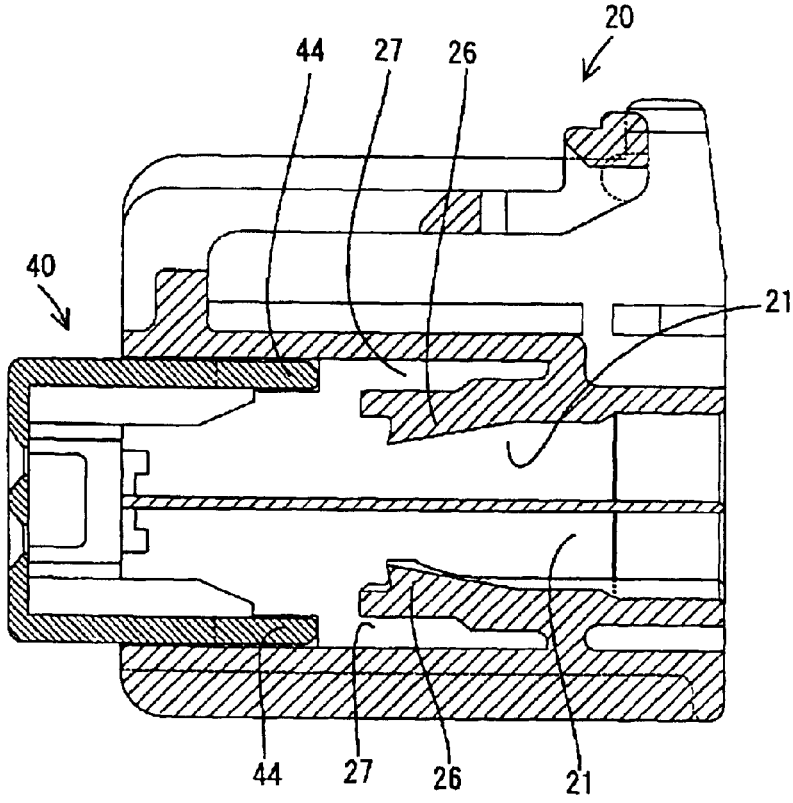
FIG. 8 is a longitudinal section showing the state of FIG. 7.

The retainer 40 can be held at a partial locking position (see FIG. 8) where the intruding pieces 44 are retracted forward from the deformation spaces 27 for the locks 26 and a full locking position (see FIG. 13) where the intruding pieces 44 project into the deformation spaces 27 for the locks 26.

Figure 1:
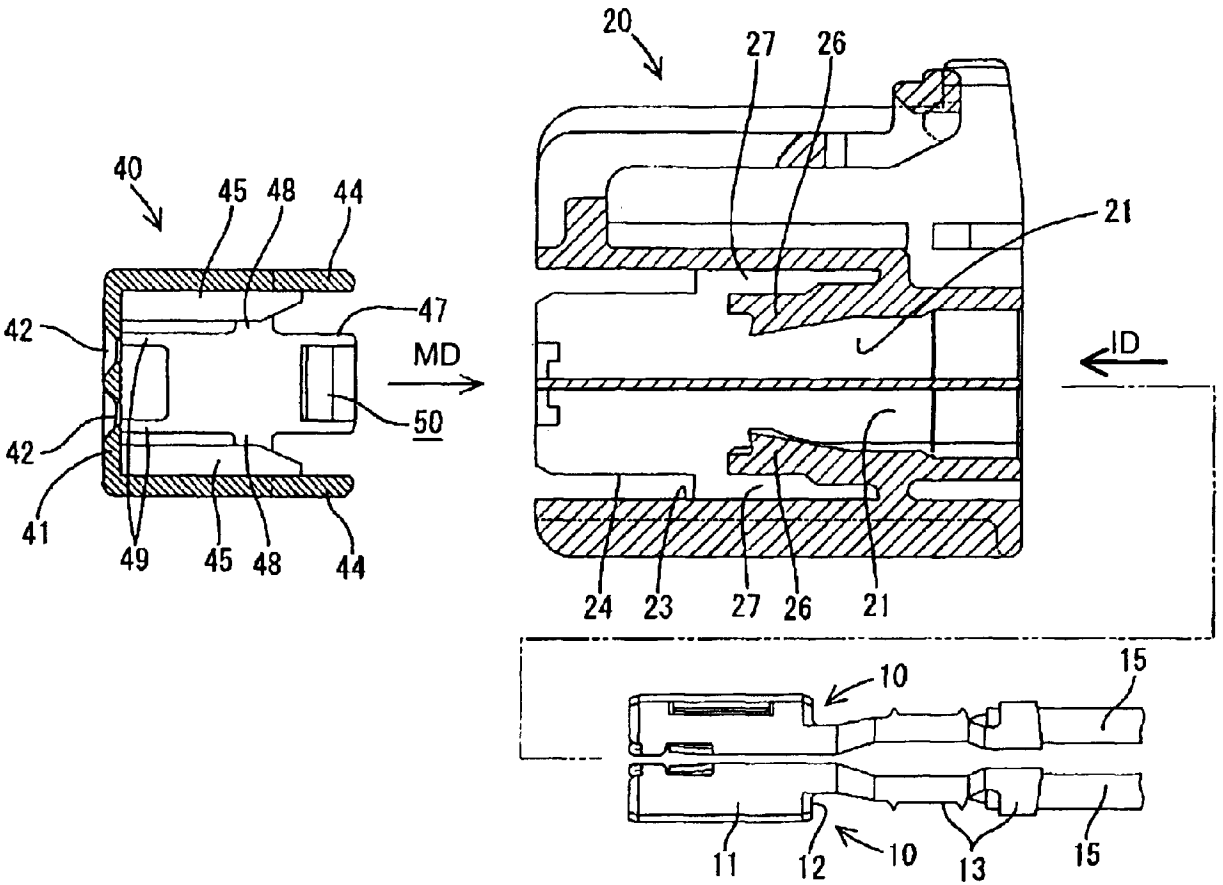
FIG. 1 is an exploded longitudinal section showing one embodiment of the present invention.

Locking pieces 47 are formed at the left and right sides of the retainer 40. Each locking piece 47 extends back from the front plate 41 in a mounting direction MD of the retainer 40 to the female housing 20 (rightward in FIG. 1) and is disposed substantially centrally along the height of the side surface. Supports 48 couple the upper and lower edge of each locking piece 47, and are substantially in the longitudinal middle of the respective locking piece 47. A forked coupling 49 couples a front end of each locking piece 47 to the front plate 41. The locking piece 47 is pivotally displaceable in and/or back like a seesaw about the supports 48 while deforming the forked coupling 49.

A projection 50 is formed on the inner side of an extending end of each locking piece 47. The projection 50 is a relatively short trapezoid that extends over substantially the entire width of the locking piece 47 in an area before the supports 48 as seen in the mounting direction MD. The projection 50 is slightly over half the length of a portion of the locking piece 47 before the supports 48. A contact surface 51 is defined at the leading end of the projection 50 and is substantially normal to the length of the locking piece 47. An engaging surface 52 is defined at the rear end of the projection 50 and is at an acute angle to the locking piece 47. A guiding surface 53 is defined at the leading inner surface of the engageable portion 50 and slopes moderately down and out toward the leading end. The slanted engaging surface 52 and the locking surface 32 are sloped to be substantially parallel to each other.

A pressable portion 55 is formed between the supports 48 and the forked coupling 49, and is operable to pivot the locking piece 47.

Shallow guide grooves 30 extend forward and back in opposite sides of the tower 24, as shown in FIG. 2, and are aligned to guide the engageable portion 50 of the corresponding locking piece 47. Partial locking projections 31 and full locking projections 35 are formed in each guide groove 30 and are spaced apart along the mounting direction MD. A space between the projections 31, 35 is set so that the engageable portion 50 of the locking piece 47 can fit closely therebetween. Moreover, the two projections 31, 35 are displaced with respect to each other along a direction substantially normal to the mounting direction MD.

The partial locking projection 31 is formed on one side of each guide groove 30 for engaging the lower half of the engageable portion 50 of the locking piece 47. The rear side (right side in FIG. 3) of the partial locking projection 31, as seen in the mounting direction MD, is a relatively steep locking surface 32 aligned an angle of between about 70° to 90° to the mounting direction MD. The front side of the locking projection 31 is a guiding surface 33 with a more moderately sloped angle of between about 10° to 60° with respect to the mounting direction MD.

The full locking projection 35 is formed on the side of each guide groove 30 opposite the partial locking projection 31 for engaging the upper half of the engageable portion 50 of the locking piece 47. The rear side of the full locking projection 35, as seen in the mounting direction MD, is a relatively steep locking surface 36 aligned at an angle of between about 70° to 90° to the mounting direction MD. The front side (left side in FIG. 3) of each full locking projection 35 has an overhanging restricting surface 37 for contacting the contact surface 51 of the engageable portion 50 of the corresponding locking piece 47.

Figure 9:
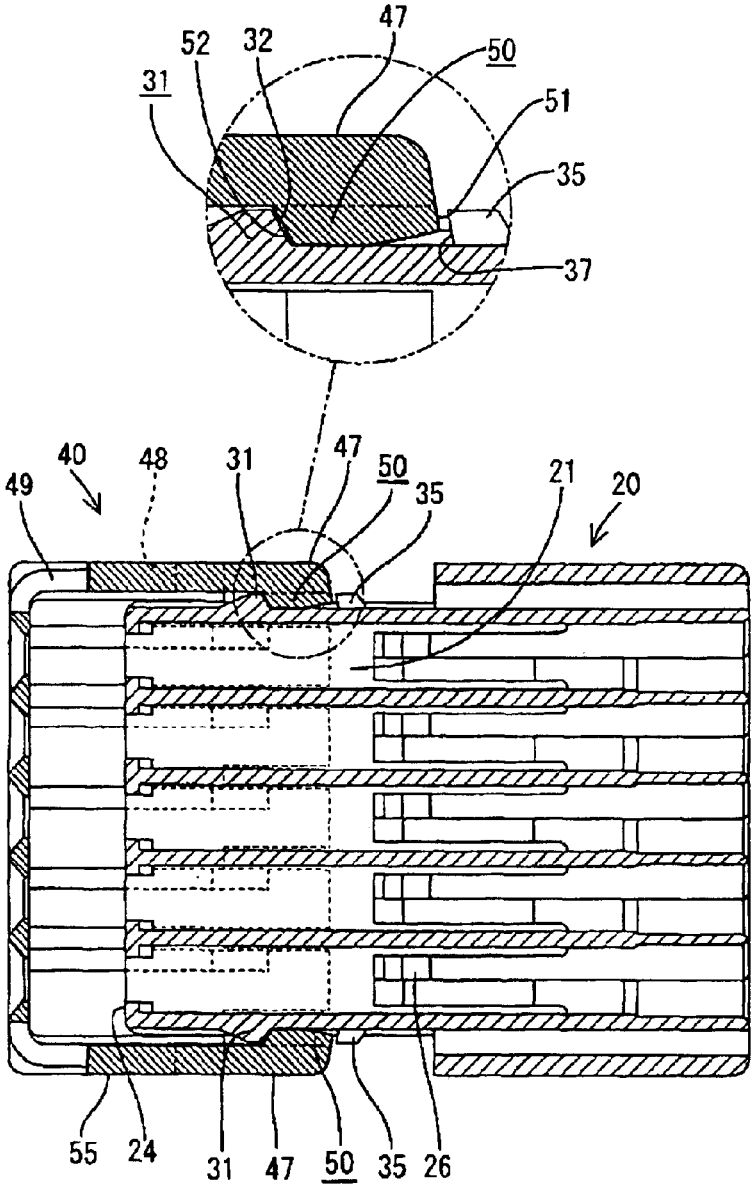
FIG. 9 is a plan view in section showing the state of FIG. 7.

The retainer 40 can be held at the partial locking position when the engaging surfaces 52 of the engageable portions 50 of the locking pieces 47 engage the locking surfaces 32 of the partial locking projections 31 (see FIG. 9). The retainer 40 also can be held at the full locking position so as not to come off when the engaging surfaces 52 of the engageable portions 50 engage the locking surfaces 36 of the full locking projections 35 (see FIG. 14).

The female connector is assembled by partly fitting the retainer 40 in the mounting direction MD on the front end of the tower 24 of the female housing 20. The retainer 40 is pushed so that the engageable portions 50 of the two locking pieces 47 move along the guiding grooves 30 and onto the guiding surfaces 33 of the partial locking projections 31. Thus, the extending sides of the locking pieces 47 displace pivotally outward.

Figure 7:
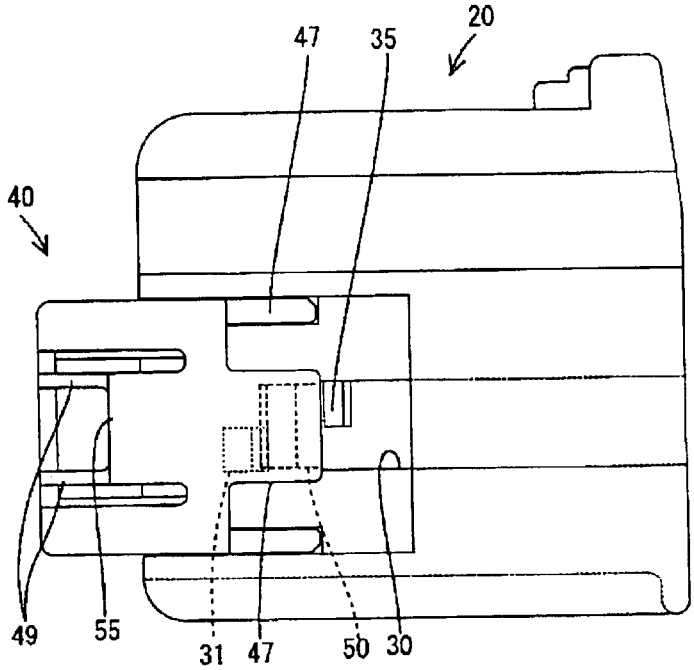
FIG. 7 is a side view showing the retainer at a partial locking position.

The retainer 40 is pushed until the engageable portions 50 of the locking pieces 47 move over the partial locking projections 31. Thus, the locking pieces 47 return towards their original postures, as shown in FIGS. 7 and 9, and the engaging surfaces 52 of the engageable portions 50 engage the locking surfaces 32 of the partial locking projections 31. As a result, the retainer 40 is held at the partial locking position. The intruding pieces 44 are spaced from the deformation spaces 27 for the locks 26 when the retainer 40 is at the partial locking position.

The contact surfaces 51 of the engageable portions 50 of the locking pieces 47 are substantially opposed to the restricting surfaces 37 of the full locking projection 35 when the retainer 40 is held at the partial locking position.

The subassembled female housing 20 is transported to a site for inserting the female terminals 10 with the retainer 40 at the partial locking position. Other connectors may strike against the retainer 40 during transportation. However, the contact surfaces 51 of the engageable portions 50 of the locking pieces 47 contact the overhanging restricting surfaces 37 of the full locking projections 35 to prevent the retainer 40 from being pushed further. Thus, there is no possibility of inadvertently pushing the retainer 40 to the full locking projection.

Figure 10:
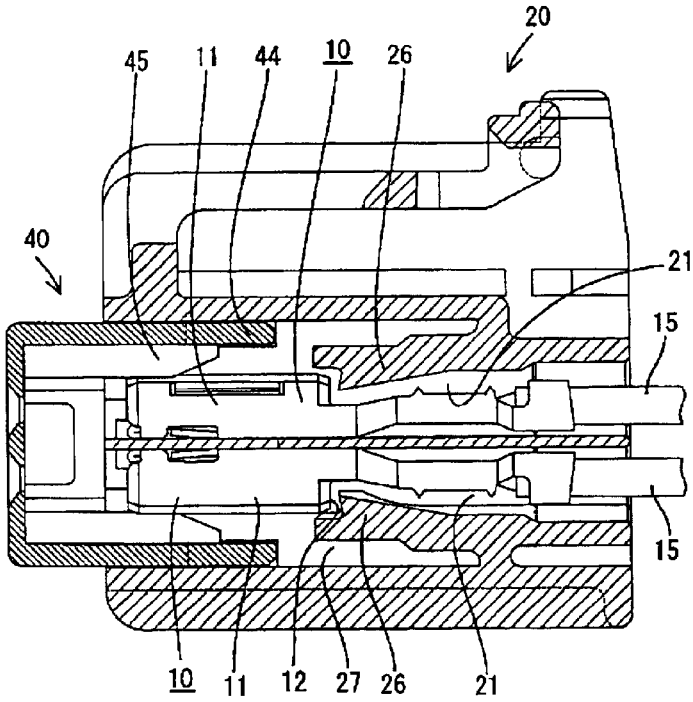
FIG. 10 is a longitudinal section showing a state where female terminals are inserted.

The female terminals 10 then are inserted along the inserting direction ID into the respective cavities 21 of the female housing 20 from the inserting side while the retainer 40 is at the partial locking position. Thus, the intruding pieces 44 are retracted from the deformation spaces 27. The pushing force of each female terminal 10 resiliently deforms the respective lock 26 into the deformation space 27. However, the lock 26 is restored to engage the jaw 12 of the connecting portion 11, as shown in FIG. 10, when the female terminal 10 is inserted to a substantially proper position. As a result, the female terminal 10 is locked partially.

Figure 11:
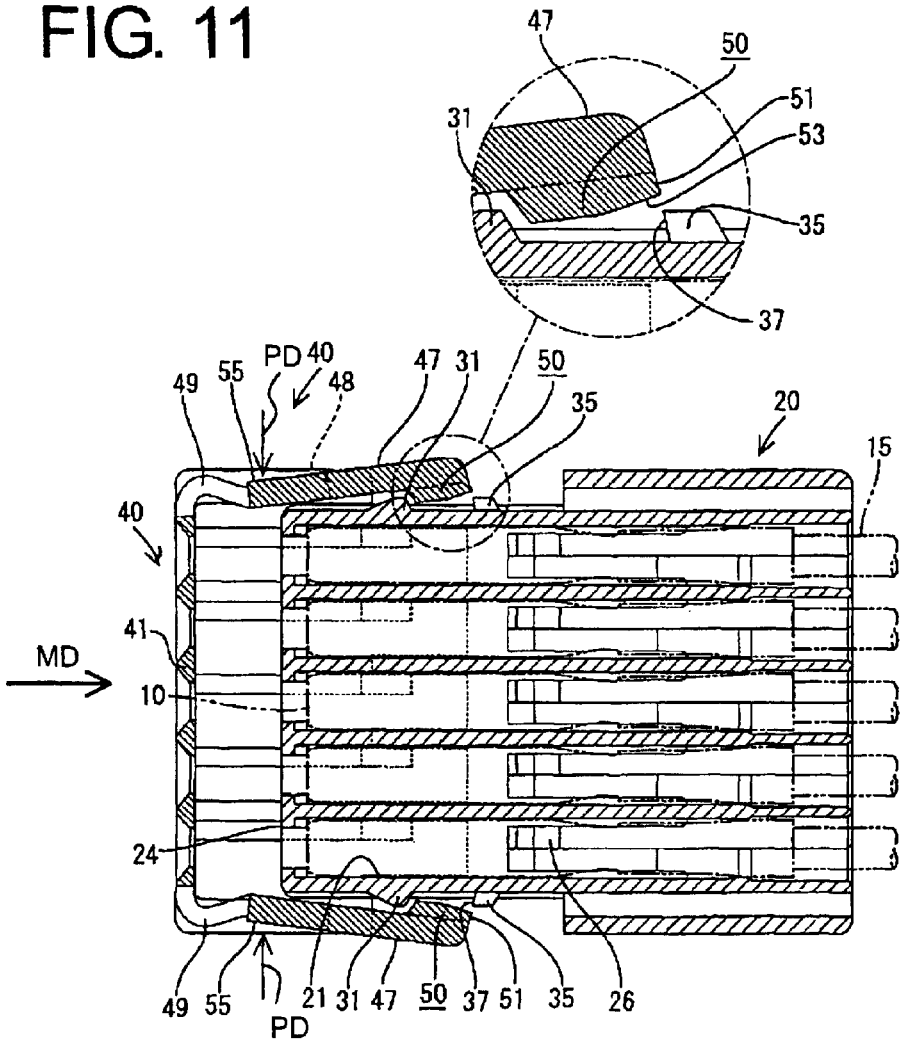
FIG. 11 is a plan view in section showing a state where a restriction to prevent the retainer from being pushed is canceled.

The retainer 40 is moved in the mounting direction MD to the full locking position after the female terminals 10 have been accommodated. More particularly, the pressable portions 55 of the locking pieces 47 then are pressed in a pressing direction PD as indicated by arrows in FIG. 11 while the opposite side surfaces of the retainer 40 are held e.g. by fingers. The pushing directions PD are substantially normal to the mounting direction MD. The locking pieces 47 then are displaced pivotally outward in a lever fashion to disengage the contact surfaces 51 of the engageable portions 50 from the restricting surfaces 37 of the full locking projections 35. Further pushing forces in the mounting direction MD push the retainer 40 while the guiding surfaces 53 of the engageable portions 50 move onto the guiding surfaces 53 of the engageable portions 50.

Figure 12:
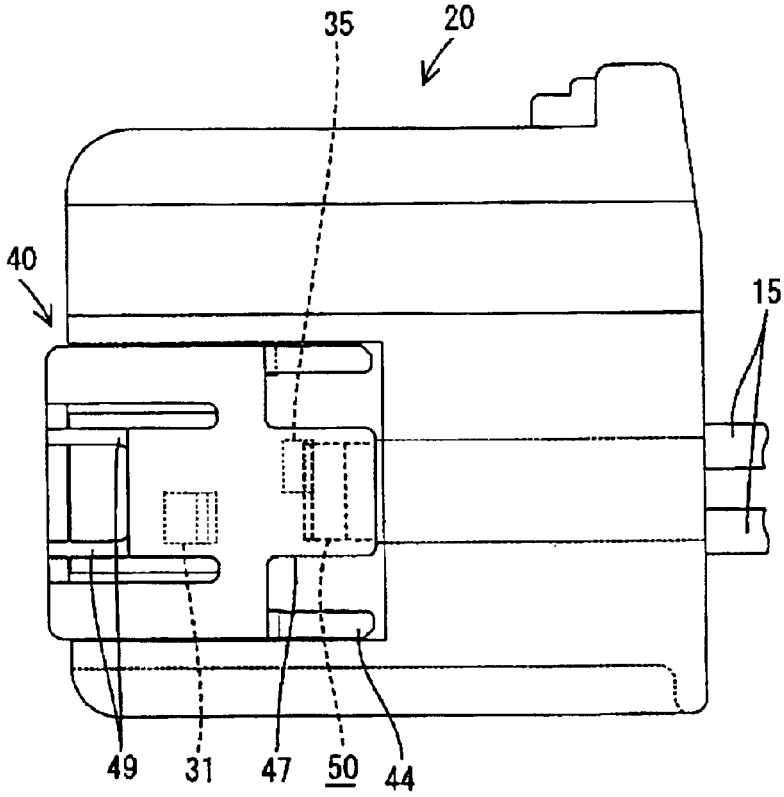
FIG. 12 is a side view showing the retainer at a full locking position.
Figure 14:
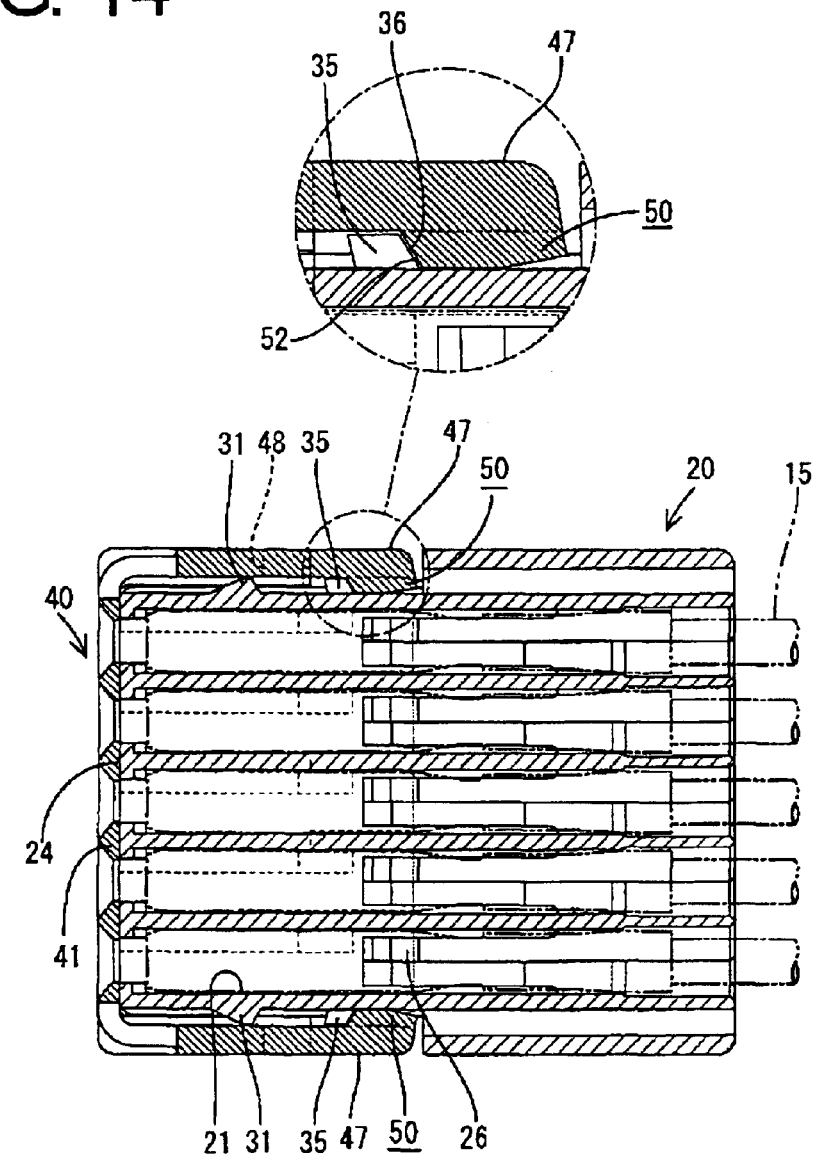
FIG. 14 is a plan view in section showing the state of FIG. 12.

The retainer 40 is pushed in the mounting direction MD until the front plate 41 contacts the front surface of the tower 24. Pushing forces in the pushing directions PD on the pressable portions 55 then are released. Thus, the locking pieces 47 return to their original postures and the engageable portions 50 engage the locking surfaces 36 of the full locking projections 35, as shown in FIGS. 12, 14. The engageable portions 50 have already passed the full locking projections 35 and engage the engaging surfaces 52. As a result, the retainer 40 is held at the full locking position and will not to come off.

Figure 13:
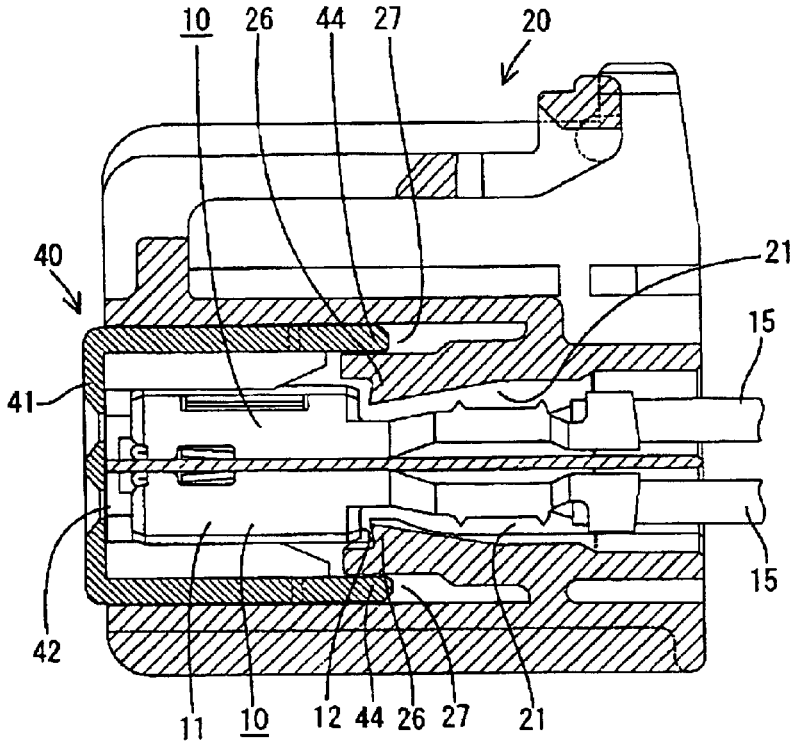
FIG. 13 is a longitudinal section showing the state of FIG. 12.

The intruding pieces 44 of the retainer 40 enter the deformation spaces 27, as shown in FIG. 13. Thus, the locks 26 cannot deform and the female terminals 10 indirectly are locked doubly. The female housing 20 can be connected with an unillustrated mating male housing in this state.

As described above, the retainer 40 at the partial locking position may be pushed by external matter. However, the contact surfaces 51 of the engageable portions 50 of the locking pieces 47 contact the restricting surfaces 37 of the full locking projections 35 to prevent the retainer 40 from being pushed to the full locking position. On the other hand, such a restriction can be canceled by pressing and displacing the locking pieces 47 in a lever fashion. The retainer 40 then can be pushed in the mounting direction MD toward the full locking position. The retainer 40 cannot be pushed in the mounting direction MD to the full locking position until the locking pieces 47 are pressed in the pressing directions PD. Accordingly, the retainer 40 cannot be pushed inadvertently to the full locking position.

The connector has a simple construction since the locking pieces 47 possess a function of holding the retainer 40 at the partial locking position and/or at the full locking position.

The locking pieces 47 can be held by the fingers and pressed in the pressing directions PD to cancel the restriction on the retainer 40. The retainer 40 can reach the full locking position by being pushed in the mounting direction MD while continuing to be held by fingers. As a result, the operation from the cancellation of the restriction by the locking pieces 47 to the pushing of the retainer 40 to the full locking position is performed smoothly by one continuous movement.

The invention is not limited to the above described and illustrated embodiment. For example, the following embodiments also are embraced by the invention as defined by the claims. Beside the following embodiments, various changes can be made without departing from the scope and spirit of the present invention as defined by the claims.

The locking piece having the function of preventing the retainer from being pushed to the full locking position may be provided at either one of the left and right or lateral surfaces of the retainer.

The locking piece having the function of preventing the retainer from being pushed to the full locking position may be provided separately from a mechanism for holding the retainer at the partial locking or full locking position.

The invention is not limited to the female connector illustrated in the foregoing embodiment and may be applied to male connectors.

The invention is not limited to front-type retainers, but is also applicable to side type retainers.

The invention is not limited to retainers for preventing a disengagement of the lock by being inserted into a deformation permitting space for the resilient locking piece, but is also applicable to retainers directly engaging the terminal fittings to lock or doubly lock them.

The invention is also applicable to connectors in which the terminal fittings are locked only by the retainer.

What is claimed is:

1. A connector, comprising:

a housing formed with at least one cavity into which at least one terminal fitting is insertable, a restricting portion being formed on an outwardly facing surface of the housing; and a retainer for locking the terminal fitting, the retainer being mounted on a retainer mounting surface of the housing for movement between a first locking position where the retainer permits insertion and withdrawal of the terminal fitting into and from the cavity and a second locking position where the retainer locks the terminal fittings, the retainer having at least one resiliently deformable locking piece with an inwardly directed engageable portion at one end of the locking piece for preventing the retainer from being pushed from the first locking position to the second locking position by engaging the restricting portion on the housing, and the locking piece having a pressing portion at an opposed end and a pivot between the ends, the pressing portion being configured to be pressed inwardly so that the portions of the locking piece adjacent the engageable portion are deformed outwardly and out of engagement with the restricting portion.

2. The connector of claim 1, wherein the cavity has a resiliently deformable lock for partially locking the terminal fitting in the cavity.

3. The connector of claim 2, wherein in the first locking position the retainer is retracted from deformation spaces for the locks to permit the insertion and withdrawal of the terminal fittings into and from the cavities; and wherein in the second locking position the retainer enters the deformation spaces to prevent deformation of the locks.

4. The connector of claim 1, wherein the restricting portion is a projection, and the retainer is prevented from being pushed to the second locking position by contact of the engageable portion provided at a projecting end of the locking piece with one surface of the restricting portion.

5. The connector of claim 4, wherein the retainer is held at the second locking position so as not to come off by the contact of the engageable portion with another surface of the restricting portion.

6. The connector of claim 5, wherein an inner surface of the engageable portion at the leading end surface is formed into a guiding surface sloped moderately outwardly toward the leading end.

7. The connector according of claim 1, wherein two locking pieces are provided at substantially opposite side surfaces of the retainer.

8. The connector of claim 1, wherein the locking piece is supported pivotably on the retainer by supports.

9. The connector of claim 8, wherein the locking piece is pivotally displaceable about the supports while deforming a deformable portion.

10. The connector of claim 1, wherein the locking piece is pressable in a pushing direction arranged at an angle to a mounting direction of the retainer.

11. A connector, comprising:

a housing with opposite front and rear ends and at least one cavity extending between the front and rear ends for receiving a terminal fitting, the housing further having opposite first and second outwardly facing side surfaces and restricting portions being formed respectively on the side surfaces of the housing; and a retainer mounted on the housing at a first locking position where the retainer permits insertion of the terminal fitting into the cavity, the retainer having first and second resiliently deformable locking pieces having engageable portions engaged respectively with the first and second restricting portions on the housing for preventing the retainer from being pushed along a moving direction beyond the first locking position, the first and second locking pieces each having a pressing portion configured to be pressed manually inwardly and towards one another in a pressing direction aligned at an angle to the moving direction for deforming the locking pieces so that the engageable portions move outwardly and out of engagement with the restricting portions, thereby permitting the retainer to be moved in the moving direction to a second locking position where the retainer locks the terminal fittings.

12. The connector of claim 11, wherein the cavity has a resiliently deformable lock for partially locking the terminal fitting in the cavity.

13. The connector of claim 12, wherein the retainer, in the first locking position, is retracted from deformation spaces for the locks to permit the insertion of the terminal fitting into the cavity; and wherein the retainer, in the second locking position, enters the deformation spaces to prevent deformation of the locks.

14. The connector of claim 11, wherein the restricting portions are projections, and an engageable portion being formed at a projecting end of each of the locking pieces for engaging a surface of the respective restricting portion for preventing the retainer from being pushed to the second locking position.

15. The connector of claim 14, wherein the retainer is held at the second locking position so as not to come off by the contact of each said engageable portion with another surface of the respective restricting portion.

16. The connector of claim 11, wherein the locking pieces are supported pivotably on the retainer by supports.

* * * * *